US006724360B2

(12) United States Patent
Kondoh

(10) Patent No.: US 6,724,360 B2
(45) Date of Patent: Apr. 20, 2004

(54) ANTIFERROELECTRIC LIQUID CRYSTAL DISPLAY

(75) Inventor: Shinya Kondoh, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 208 days.

(21) Appl. No.: 09/840,865

(22) Filed: Apr. 25, 2001

(65) Prior Publication Data

US 2002/0158831 A1 Oct. 31, 2002

(51) Int. Cl.[7] ..... G09G 3/36

(52) U.S. Cl. ..... 345/97; 345/94; 345/87; 345/99; 345/96; 345/98; 345/102; 345/95; 345/208

(58) Field of Search ..... 345/97.94, 87.99, 345/94–95, 208

(56) References Cited

U.S. PATENT DOCUMENTS

| | | | | |
|---|---|---|---|---|
| 4,642,537 A | * | 2/1987 | Young | 318/254 |
| 6,233,634 B1 | * | 5/2001 | Clark et al. | 710/313 |
| 6,535,191 B1 | * | 3/2003 | Miyachi | 345/94 |

FOREIGN PATENT DOCUMENTS

| | | | |
|---|---|---|---|
| JP | 03-078792 | * | 4/1991 |
| JP | 04249290 A | | 9/1992 |
| JP | 09-172579 | * | 12/1995 |
| JP | 09090388 A | | 3/1997 |
| JP | 09222593 A | | 8/1997 |
| JP | 10123486 A | | 5/1998 |
| JP | 10253943 A | | 9/1998 |
| JP | 10253944 A | | 9/1998 |
| JP | 10307284 A | | 11/1998 |
| JP | 11174415 A | | 7/1999 |
| JP | 2000-321555 | | 11/2000 |
| WO | WO 01/13167 A1 | | 2/2001 |

* cited by examiner

*Primary Examiner*—Vijay Shankar
*Assistant Examiner*—Leonid Shapiro
(74) *Attorney, Agent, or Firm*—Finnegan, Henderson, Farabow, Garrett & Dunner, L.L.P.

(57) ABSTRACT

An antiferroelectric liquid crystal display, which is equipped with an antiferroelectric liquid crystal panel having an antiferroelectric liquid crystal sandwiched between a pair of substrates, performs at least one scanning period when carrying out a display based on one set of display data, wherein the scanning period comprises a selection period for determining the state of the antiferroelectric liquid crystal, a non-selection period for holding the state determined in the selection period, and a reset period for resetting pixels to a black display state before initiating the selection period. The length of the reset period is adjusted according to the speed of change in the display data. Alternatively, the pixels are reset to a white display state in the reset period and, during that period, the backlight is turned off.

12 Claims, 12 Drawing Sheets

ANTIFERROELECTRIC LIQUID CRYSTAL DISPLAY

BACKGROUND OF THE INVENTION

1. Field of the Invention

The present invention relates to an antiferroelectric liquid crystal display, such as a liquid crystal display panel or a liquid crystal optical shutter array, that has a liquid crystal layer of antiferroelectric liquid crystal.

2. Description of the Related Art

Liquid crystal panels using antiferroelectric liquid crystals have been researched vigorously since it was reported in Japanese Unexamined Patent Publication No. 2-173724 by Nippondenso and Showa Shell Sekiyu that such liquid crystal panels provide wide viewing angles, are capable of fast response, and have good multiplexing characteristics.

In traditional liquid crystal displays using conventional liquid crystals such as nematic liquid crystals, when a rapidly changing image is displayed on the screen, the screen cannot respond quickly to the changes of the image. For example, in a video game, when an image of a ball moving around is displayed on a liquid crystal display, there occurs the phenomenon that the contour of the ball cannot be displayed distinctly and the image is blurred (this phenomenon will hereinafter be referred to as the "image trailing phenomenon"). Previously, this image trailing phenomenon has been believed to occur because of the slow switching speeds of liquid crystal molecules. However, a recent research report shows that not only the slow switching speeds of liquid crystal molecules but the traditionally employed liquid crystal driving method is also responsible for the image trailing phenomenon. That is, the report says that in a scanning period during which an image based on display data is written to the pixels, if the image is written to the pixels without once resetting the previous image display, the previous image persists in the eye of the person viewing the display, thus causing the image trailing phenomenon.

It has been believed that antiferroelectric liquid crystals are resistant to the image trailing phenomenon because of their fast switching speeds compared with other conventional liquid crystals. However, recent research has revealed that antiferroelectric liquid crystal displays are resistant to the image trailing phenomenon, not only because of their fast switching speeds but also because of their unique driving method, that is, the inclusion of a reset period which, as earlier described, is supposed to contribute to reducing the image trailing phenomenon.

In the previous research, however, it has not been made clear as to how the antiferroelectric liquid crystals can be controlled most effectively to reduce the image trailing phenomenon. The prior known method has had the further problem that by simply providing the reset period, the image trailing phenomenon cannot be completely eliminated when displaying a moving image based on rapidly changing display data.

SUMMARY OF THE INVENTION

In view of the above situation, it is an object of the present invention to provide, in an antiferroelectric liquid crystal display using an antiferroelectric liquid crystal, an antiferroelectric liquid crystal display having an effective reset period, and achieving a good display quality by setting an optimum reset period when displaying an image, whether it be a moving image or a still image.

To attain the above object, the antiferroelectric liquid crystal display according to the present invention is equipped with an antiferroelectric liquid crystal panel having an antiferroelectric liquid crystal sandwiched between a pair of substrates, wherein the antiferroelectric liquid crystal display is provided with at least one scanning period when carrying out a display based on one set of display data, and the scanning period comprises a selection period for determining the state of the antiferroelectric liquid crystal, a non-selection period for holding the state determined in the selection period, and a reset period for resetting pixels to a black display state before initiating the selection period, and wherein the antiferroelectric liquid crystal display includes a device for adjusting the length of the reset period according to the speed of change in the display data.

The length of the reset period is increased when the speed of change in the display data is fast, and is reduced when the speed is slow.

The antiferroelectric liquid crystal display further includes a backlight and a device for adjusting the brightness of the backlight according to the length of the reset period.

The brightness of the backlight is increased when the length of the reset period is increased, and is reduced when the length is reduced.

The speed of change in the display data is detected by comparing display data of approximately successive screens (frames).

The antiferroelectric liquid crystal display is characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the polarization axis of either one of the polarizers substantially coincides with the average molecular long axis direction of the antiferroelectric liquid crystal in the absence of an applied voltage, and in that in the reset period, the antiferroelectric liquid crystal is set to the antiferroelectric state.

The antiferroelectric liquid crystal display is also characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the direction of line bisecting the angle which is made by the polarization axes of the polarizers substantially coincides with the average molecular long axis direction of the antiferroelectric liquid crystal in the absence of an applied voltage, and in that, in the reset period, the antiferroelectric liquid crystal is set to the first or second ferroelectric state.

The antiferroelectric liquid crystal display according to another aspect of the invention is equipped with a backlight and an antiferroelectric liquid crystal panel having an antiferroelectric liquid crystal sandwiched between a pair of substrates, wherein the antiferroelectric liquid crystal display is provided with at least one scanning period when carrying out a display based on display data for one frame, and the scanning period includes a selection period for determining the state of the antiferroelectric liquid crystal, a non-selection period for holding the state determined in the selection period, and a reset period for resetting all pixels simultaneously to a white display state before initiating the selection period, and wherein the backlight is turned off during the reset period.

The antiferroelectric liquid crystal display includes a device for adjusting the length of the reset period according to the speed of change in the display data.

The length of the reset period is increased when the speed of change in the display data is fast, and is reduced when the speed is slow.

The speed of change in the display data is detected by comparing display data of approximately successive screens (frames).

The antiferroelectric liquid crystal display further includes a device for adjusting the brightness of the backlight according to the length of the reset period.

The brightness of the backlight is increased when the length of the reset period is increased, and is reduced when the length is reduced.

The antiferroelectric liquid crystal display is characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the polarization axis of either one of the polarizers substantially coincides with the average molecular long axis direction of the antiferroelectric liquid crystal in the absence of an applied voltage, and in that in the reset period, the antiferroelectric liquid crystal is set to the first or second ferroelectric state.

The antiferroelectric liquid crystal display is also characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the direction of line bisecting the angle which is made by the polarization axes of the polarizers substantially coincides with the average molecular long axis direction of the antiferroelectric liquid crystal in the absence of an applied voltage, and in that in the reset period, the antiferroelectric liquid crystal is set to the antiferroelectric state.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Before describing the embodiments of the present invention, the related art and the disadvantages therein will be described with reference to the related figures.

Figure 1:
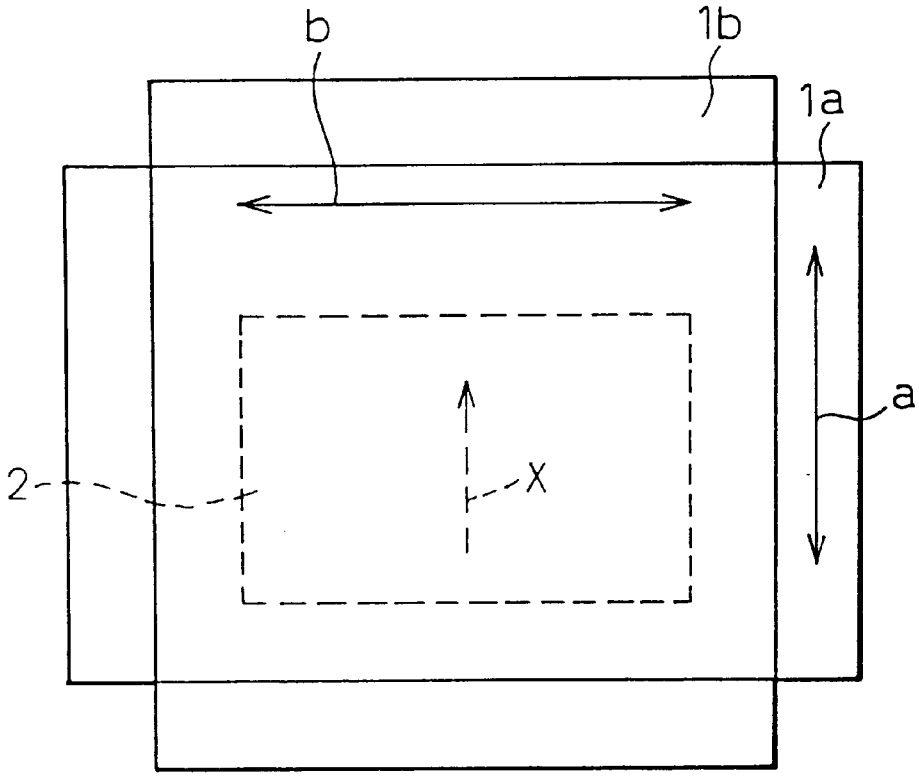
Fig. 1 PRIOR ART
FIG. 1 is a diagram showing an example of the construction of an antiferroelectric liquid crystal panel.
Figure 2:
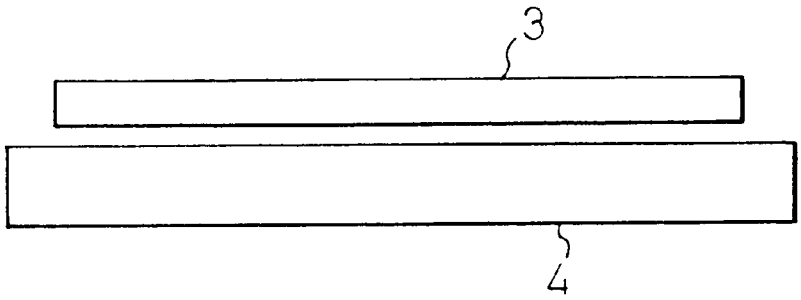
Fig. 2 PRIOR ART
FIG. 2 is a diagram showing an antiferroelectric liquid crystal display having a backlight mounted behind the antiferroelectric liquid crystal panel.

FIG. 1 is a diagram showing an example of the construction of an antiferroelectric liquid crystal panel using an antiferroelectric liquid crystal as a display element. A liquid crystal cell 2 is placed between polarizers 1*a* and 1*b* arranged in a crossed Nicol configuration, in such a manner that the average long axis direction X of antiferroelectric liquid crystal molecules in the absence of an applied voltage is oriented substantially parallel to either the polarization axis, a, of the polarizer 1*a* or the polarization axis, b, of the polarizer 1*b*. FIG. 2 shows an antiferroelectric liquid crystal display having a backlight 4 mounted behind the antiferroelectric liquid crystal panel 3. In the polarizer arrangement shown in FIG. 1, when no voltage is applied, the antiferroelectric liquid crystal exhibits an antiferroelectric state, and does not transmit light. The antiferroelectric liquid crystal panel therefore produces a black display (non-transmission state). When a voltage is applied, the antiferroelectric liquid crystal exhibits a first ferroelectric state or a second ferroelectric state, depending on the polarity of the applied voltage. In this case, the antiferroelectric liquid crystal molecules tilt at an angle relative to the polarization axis, so that light from the backlight is transmitted therethrough and a white display is produced (transmission state).

Figure 3:
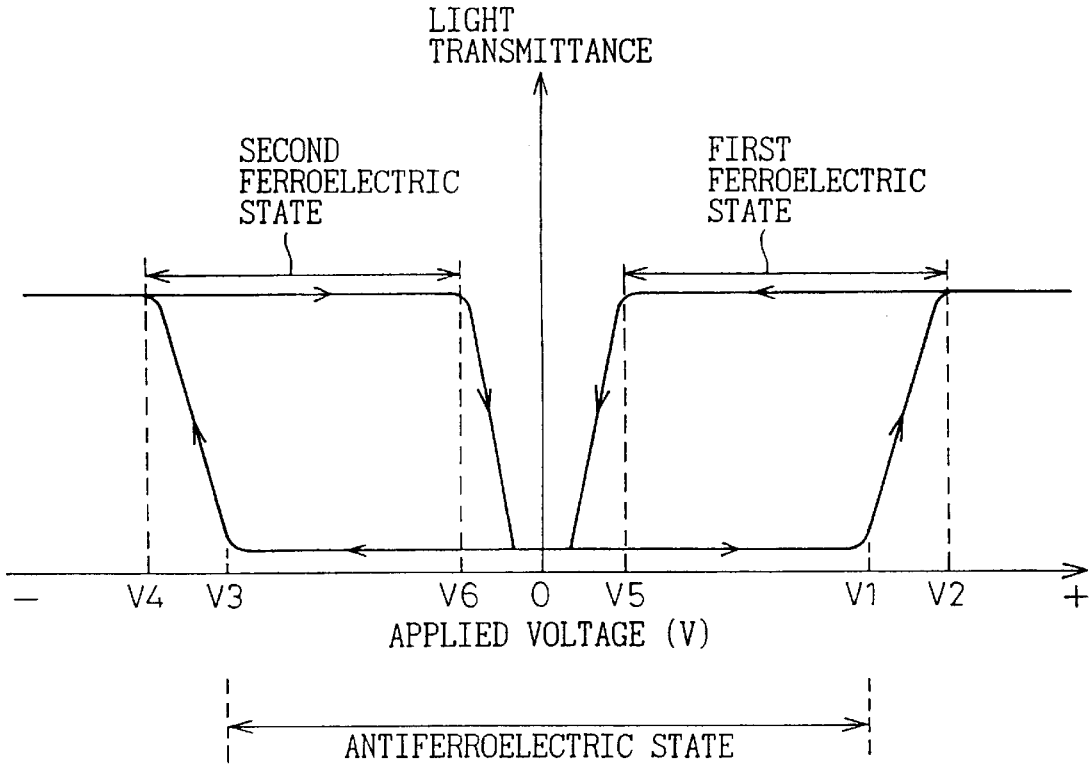
Fig. 3 PRIOR ART
FIG. 3 is a diagram showing the relationship between the value of the voltage applied to the antiferroelectric liquid crystal panel and the light transmittance of the antiferroelectric liquid crystal panel.

FIG. 3 shows the relationship between the value of the voltage applied to the antiferroelectric liquid crystal panel and the light transmittance of the antiferroelectric liquid crystal panel. As shown in FIG. 3, the antiferroelectric liquid crystal undergoes a plurality of states, that is, the antiferroelectric state in which no light is transmitted, the first ferroelectric state in which light is transmitted when a voltage of positive polarity greater in magnitude than a certain value is applied, and the second ferroelectric state in which light is transmitted when a voltage of negative polarity greater in magnitude than a certain value is applied.

Figure 4:
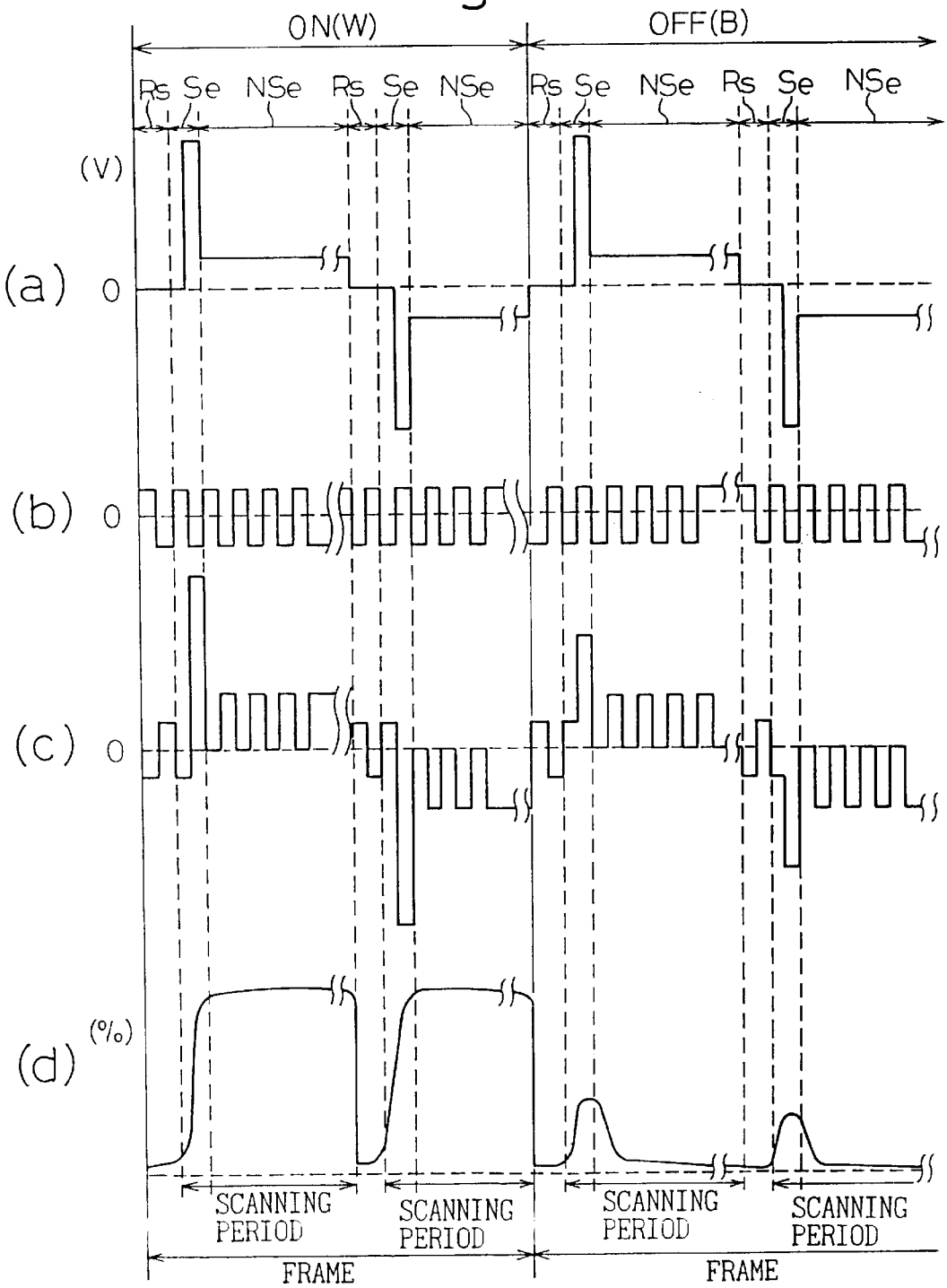
Fig. 4 PRIOR ART
FIG. 4 is a diagram showing driving waveforms for an antiferroelectric liquid crystal display.

FIG. 4 shows driving waveforms for a typical antiferroelectric liquid crystal display constructed using the antiferroelectric liquid crystal panel having the polarizer arrangement shown in FIG. 1. In FIG. 4, (a) represents a scanning voltage waveform, (b) a signal voltage waveform, (c) a composite voltage waveform, and (d) the light transmittance. A selection period (Se) for selecting a display state and a non-selection period (Nse) for maintaining the selected display state are provided within one scanning period. Preceding the selection period is a reset period (Rs) for resetting, irrespective of the previous display state, the antiferroelectric liquid crystal to the antiferroelectric state before writing the next display data. In FIG. 4, the antiferroelectric liquid crystal is reset to the antiferroelectric state. There is also used a driving method that resets the antiferroelectric liquid crystal to a ferroelectric state in the reset period. In this way, in an antiferroelectric liquid crystal display driving method, in order to produce a good display, it is generally practiced to provide a reset period for resetting the antiferroelectric liquid crystal always to the antiferroelectric or ferroelectric state, irrespective of the immediately preceding display state.

However, as previously stated, no clear description has ever been given of how the antiferroelectric liquid crystal should be controlled during the reset period to achieve the best result.

There has also been the problem that by simply providing the reset period, the image trailing phenomenon cannot be completely eliminated when displaying a moving image based on rapidly changing display data.

The inventor has conducted various studies to find a way of most effectively controlling the antiferroelectric liquid crystal during the reset period. As the result of the studies, it was found that the image trailing phenomenon can be reduced when the antiferroelectric liquid crystal is held in the black display state during the switching of display data, that is, during the interval between the end of a pixel display and the start of the next display. That is, it has been confirmed that the antiferroelectric liquid crystal should be set in the black display state (non-transmission state) during the reset period preceding the scanning period, and also that even when the reset period is provided, if the antiferroelectric liquid crystal is set in the white display state during the reset period, the image trailing phenomenon cannot be reduced satisfactorily.

As previously noted, the relationship between the light transmittance and the state of the antiferroelectric liquid crystal varies depending on the polarizer arrangement of the antiferroelectric liquid crystal panel. When the liquid crystal cell is set so that the polarization axis of either one of the polarizers is oriented in parallel to the average long axis direction of molecules in the absence of an applied voltage, as shown in FIG. 1, a black display (non-transmission state) is produced when the antiferroelectric liquid crystal is in the antiferroelectric state, and a white display (transmission state) is produced when it is in the first or second ferroelectric state, as shown in FIG. 3. In this polarizer arrangement, when the driving method shown in FIG. 4 is employed, a voltage smaller than a threshold value is applied in the reset period and the antiferroelectric liquid crystal is thus set to the antiferroelectric state, producing a black display (non-transmission state). Therefore, in the above polarizer arrangement, the image trailing phenomenon can be reduced by resetting the antiferroelectric liquid crystal to the antiferroelectric state during the reset period.

Alternatively, a driving method can be employed that applies a voltage greater than the threshold value to reset the antiferroelectric liquid crystal to the first or second ferroelectric state in the reset period (Rs). However, when the antiferroelectric liquid crystal is reset to the ferroelectric state, a white display (transmission state) is produced during the reset period, and the image trailing phenomenon cannot be reduced. To address this problem, in the antiferroelectric liquid crystal display having a backlight mounted behind the antiferroelectric liquid crystal panel as shown in FIG. 2, the backlight is turned off during the reset period. By so doing, even when the antiferroelectric liquid crystal is reset to the first or second ferroelectric state, which is the transmission state, the display appears black, not white. This achieves the same effect as when the antiferroelectric liquid crystal is placed in the non-transmission state by resetting it to the antiferroelectric state in the reset period.

Figure 5:
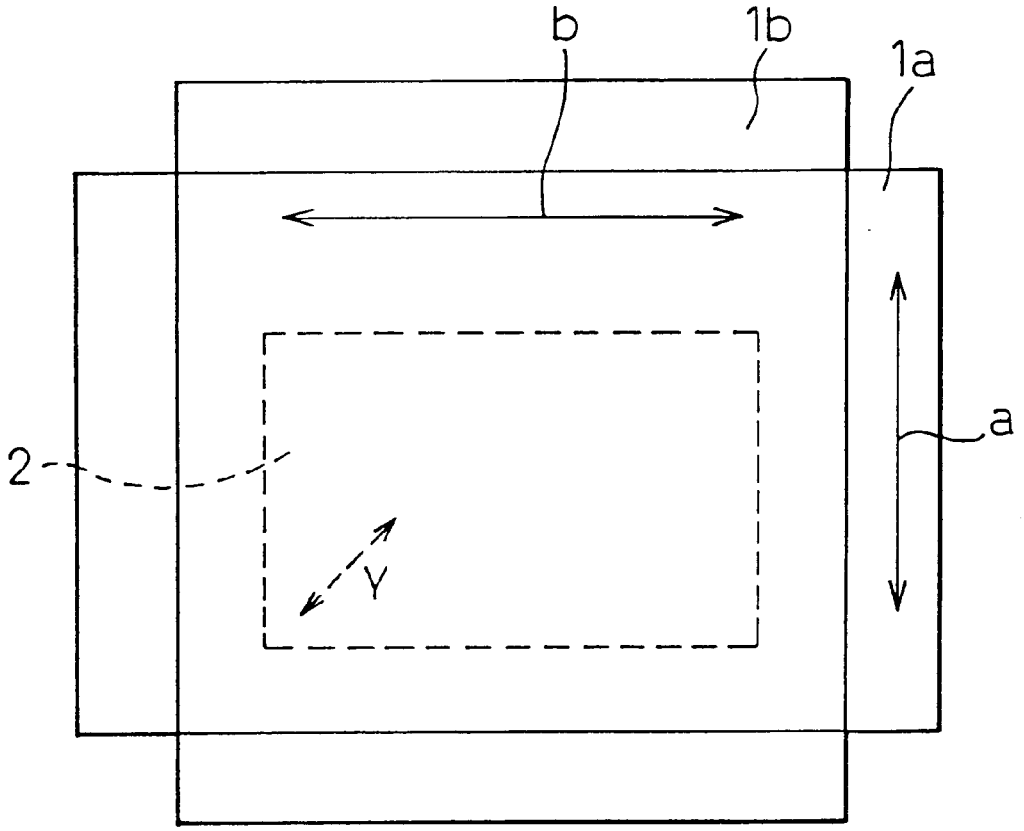
Fig. 5 PRIOR ART
FIG. 5 is a diagram showing another example of the antiferroelectric liquid crystal panel construction.
Figure 6:
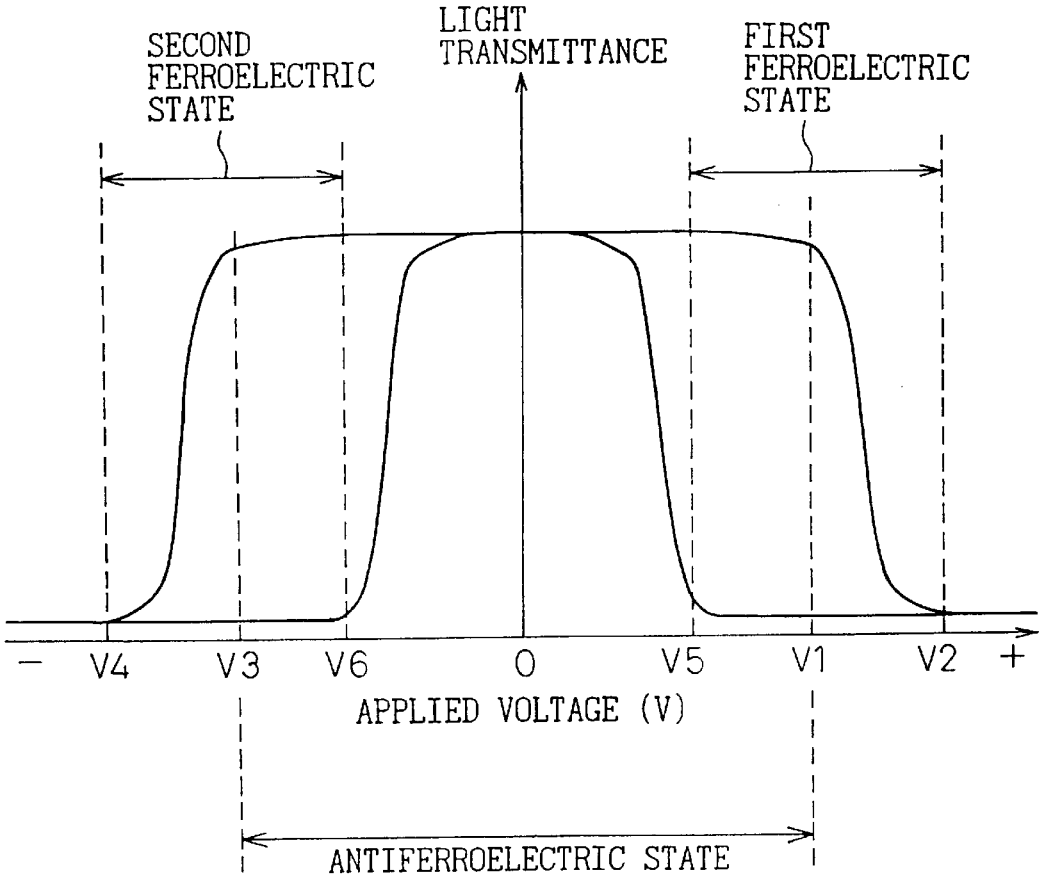
Fig.6 PRIOR ART
FIG. 6 is a graph showing the relationship between the value of the voltage applied to the antiferroelectric liquid crystal panel whose construction is shown in FIG. 5 and the light transmittance of the antiferroelectric liquid crystal panel.
Figure 7:
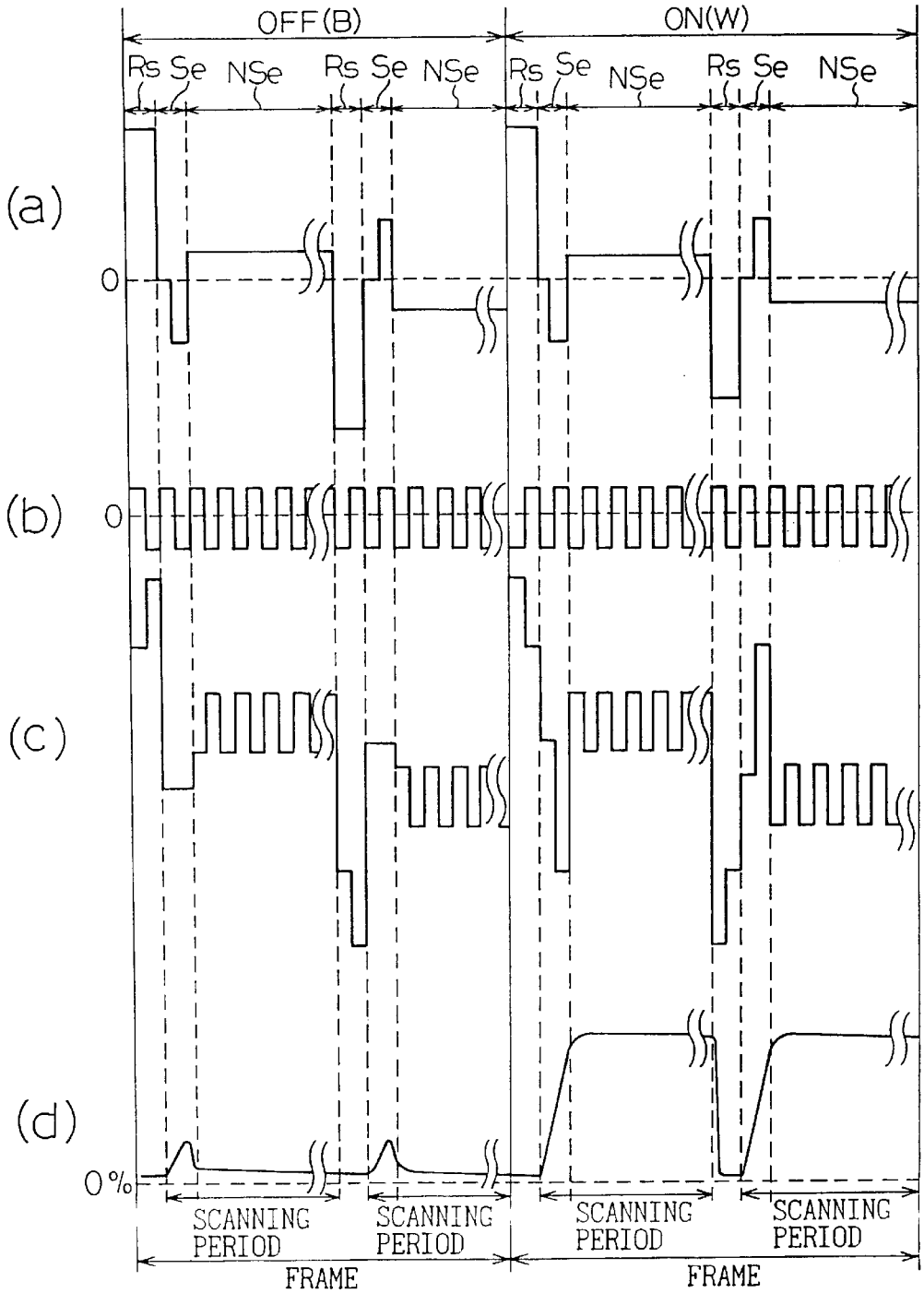
Fig.7 PRIOR ART
FIG. 7 is a diagram showing driving waveforms for the antiferroelectric liquid crystal display.

Alternatively, the liquid crystal cell can be set in such a manner that the direction of line, Y, bisecting the angle which is made by the polarization axes of the respective polarizers substantially coincides with the average molecular long axis direction of the antiferroelectric liquid crystal in the absence of an applied voltage, as shown in FIG. 5. When the polarizers are arranged in this manner, a white display (transmission state) is produced when the antiferroelectric liquid crystal is in the antiferroelectric state, and a black display (non-transmission state) when it is in the first or second ferroelectric state. In this case, the relationship between the light transmittance and the applied voltage is as shown in FIG. 6. In this polarizer arrangement, when the antiferroelectric liquid crystal display driving method shown in FIG. 7 is employed, a voltage greater than the threshold value is applied in the reset period to reset the antiferroelectric liquid crystal to the first or second ferroelectric state, and the antiferroelectric liquid crystal is thus placed in the black display state (non-transmission state). Therefore, in the above polarizer arrangement, the image trailing phenomenon can be reduced by resetting the antiferroelectric liquid crystal to the first or second ferroelectric state during the reset period. In FIG. 7, (a) is the scanning voltage waveform, (b) is the signal voltage waveform, (c) is the composite voltage waveform, and (d) is the light transmittance.

Alternatively, a driving method can be employed that applies a voltage smaller than the threshold value to reset the antiferroelectric liquid crystal to the antiferroelectric state in the reset period (Rs). In this case, however, a white display (transmission state) is produced during the reset period, and the image trailing phenomenon cannot be reduced. To address this problem, in the antiferroelectric liquid crystal display having a backlight mounted behind the antiferroelectric liquid crystal panel as shown in FIG. 2, the backlight is turned off during the reset period. By so doing, even when the antiferroelectric liquid crystal is reset to the antiferroelectric state, which is the transmission state, the display appears black, not white, and the image trailing phenomenon can thus be reduced. This achieves the same effect as when the antiferroelectric liquid crystal is placed in the non-transmission state by resetting it to the first or second ferroelectric state in the reset period.

Furthermore, it has been found that if the reset period for producing the black display is made sufficiently long, a better result can be obtained for the reduction of the image trailing phenomenon. The image trailing phenomenon becomes pronounced, particularly when displaying an image with rapid motion as in a video game. In such cases, by extending the black display producing reset period, the image trailing phenomenon is reduced, and a better result can be obtained. Conversely, when there is little motion in the displayed image, such as a still image, the image trailing phenomenon can be reduced sufficiently, even if the length of the black producing reset period is reduced.

While increasing the length of the black display producing reset period offers the advantage of reducing the image trailing phenomenon, the disadvantage is that the brightness of the entire display decreases and a good display quality cannot be obtained. To address this, the length of the reset period is adjusted according to the image displayed and, at the same time, the brightness of the backlight is adjusted according to the length of the reset period. For example, when the reset period is increased in length, since the entire display darkens, the brightness of the backlight is increased correspondingly. On the other hand, when the reset period is short, the brightness of the backlight is not increased or is set lower. By providing a mechanism for adjusting the brightness of the backlight in this manner, if the length of the reset period varies, the screen brightness does not change appreciably, and the optimum display quality can always be obtained.

Embodiment 1

Figure 8:
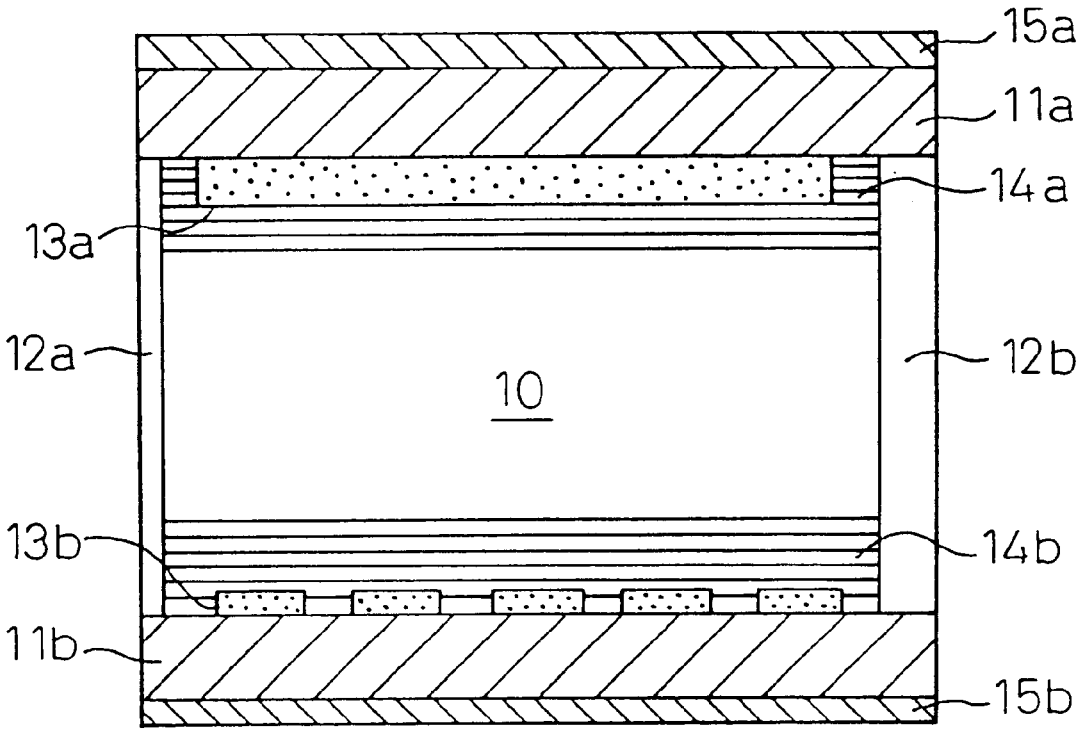
Fig.8 PRIOR ART
FIG. 8 is a diagram showing the panel structure of an antiferroelectric liquid crystal panel.

The embodiments of the present invention will be described in detail below with reference to the related drawings. FIG. 8 is a diagram showing the panel structure of an antiferroelectric liquid crystal panel used in a first embodiment of the present invention. The liquid crystal panel used in this embodiment comprises a pair of glass substrates 11*a* and 11*b* sandwiching therebetween an antiferroelectric liquid crystal layer 10 of thickness about 1.7 μm, and sealing members 12*a* and 12*b* for bonding the two glass substrates together. On the opposing surfaces of the glass substrates 11*a* and 11*b* are formed electrodes 13*a* and 13*b*, which are coated with polymeric alignment films 14*a* and 14*b*, respectively, and are thus treated for alignment. On the outside surface of one glass substrate is arranged a first polarizer 15*a* with its polarization axis oriented parallel to the average molecular axis of the liquid crystal molecules in the absence of an applied voltage; on the outside surface of the other glass substrate, a second polarizer 15*b* is arranged with its polarization axis oriented at 90° to the polarizing axis of the first polarizer 15*a*.

Figure 9:
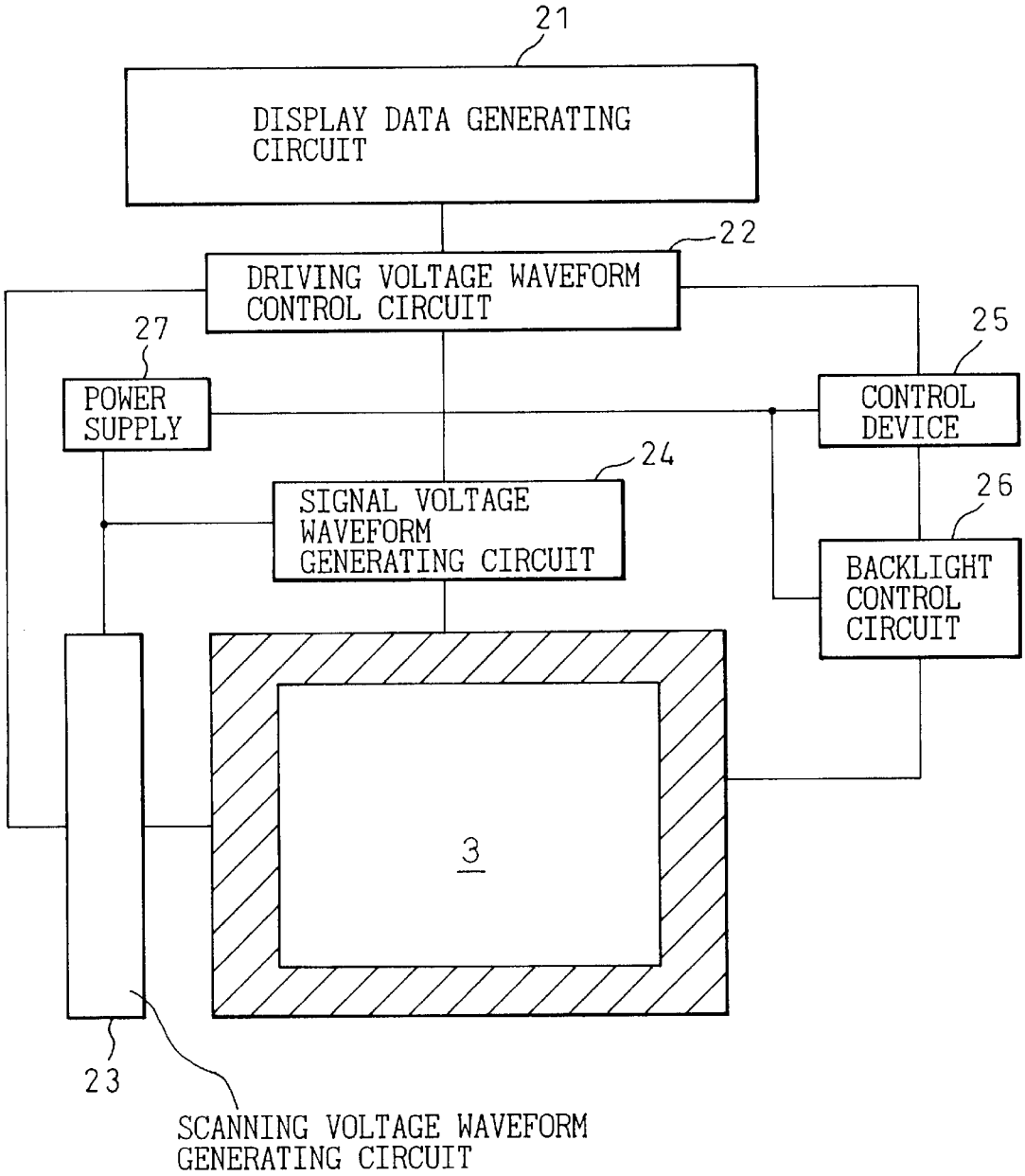
FIG. 9 is a block diagram showing the configuration of an antiferroelectric liquid crystal display used in the present invention.

FIG. 9 is a block diagram of an antiferroelectric liquid crystal display used in the present invention. The antiferroelectric liquid crystal display of the present invention comprises the antiferroelectric liquid crystal panel 3, a display data generating circuit 21, a driving voltage waveform control circuit 22, a scanning voltage waveform generating circuit 23, a signal voltage waveform generating circuit 24, a reset period adjusting control device 25, a backlight control circuit 26, and a power supply circuit 27. As a mechanism for adjusting the length of the reset period, the reset period adjusting control device 25 is used to adjust the length of the reset period. On the other hand, the backlight control circuit 26 is used to adjust the brightness of the backlight.

FIG. 4 illustrates the driving method used in the conventional art, but the same method can be used in the present invention. In FIG. 4, part (d) shows how the amount of light transmitted through the liquid crystal panel changes according to the applied voltage waveform during the ON (white display state) and OFF (black display state) periods (the change of the amount of light will hereinafter be referred to as the "change of light transmittance"). The driving waveform shown in FIG. 4 comprises two scanning periods to display an image based on display data of one frame, and the polarity of the voltage waveform is reversed symmetrically about 0 V between the two scanning periods. In the figure, two scanning periods are provided, but only one or three or more scanning periods may be provided; that is, at least one scanning period should be provided. This also applies to other embodiments described herein. Each scanning period comprises a selection period (Se) for determining the display state based on the pixel display data and a non-selection period (NSe) for maintaining the state determined in the selection period (Se), and a reset period (Rs) for resetting the display always to a prescribed state, irrespective of the previous display state, is provided before the scanning period. In the present embodiment, since the polarizers are arranged as shown in FIG. 1, when the composite voltage applied to each pixel during the reset period is set smaller than the threshold value, the antiferroelectric liquid crystal is always reset to the antiferroelectric state, regardless of the display data, and the display is thus set in the black display state.

In FIG. 4, in the first scanning period of the scanning voltage waveform (a), a voltage of 0 V is applied in the first phase of the selection period, a voltage of 20 V is applied in the second phase of the selection period, a voltage of 8 V is applied during the non-selection period, and a voltage of 0 V is applied during the reset period. On the other hand, in the second scanning period, a voltage of 0 V is applied in the first phase of the selection period, a voltage of −20 V is applied in the second phase of the selection period, a voltage of −8 V is applied during the non-selection period, and a voltage of 0 V is applied during the reset period. From the signal voltage waveform, voltages of ±5 V are applied. The pulse width of each pulse is chosen to be about 35 μs.

When the display data is ON (white display state), the composite voltage waveform applied during the second phase of the selection period exceeds the threshold of the antiferroelectric liquid crystal which is thus set in the first or second ferroelectric state, and this state is maintained throughout the non-selection period, thus producing the white display. On the other hand, when the display data is OFF (black display state), since the display is set in the black display state in the reset period regardless of the previous display state, the composite voltage smaller than the threshold voltage is applied during the selection period, and thus the black display state achieved in the reset period is maintained.

When displaying an image based on rapidly changing display data, such as a moving image with rapid motion, as in a video game, provisions were made to enable the person viewing the image to set the reset period longer by using the reset period adjusting control device 25 shown in FIG. 9 while he or she was observing the condition of the displayed image. On the other hand, when there was little motion in the displayed image, such as a still image, that is, when the displayed image was changing only slowly, the length of the reset period was reduced. With these provisions, the image trailing phenomenon was not observed whether the displayed image was a moving image with rapid motion or a still image with little motion.

Figure 10:
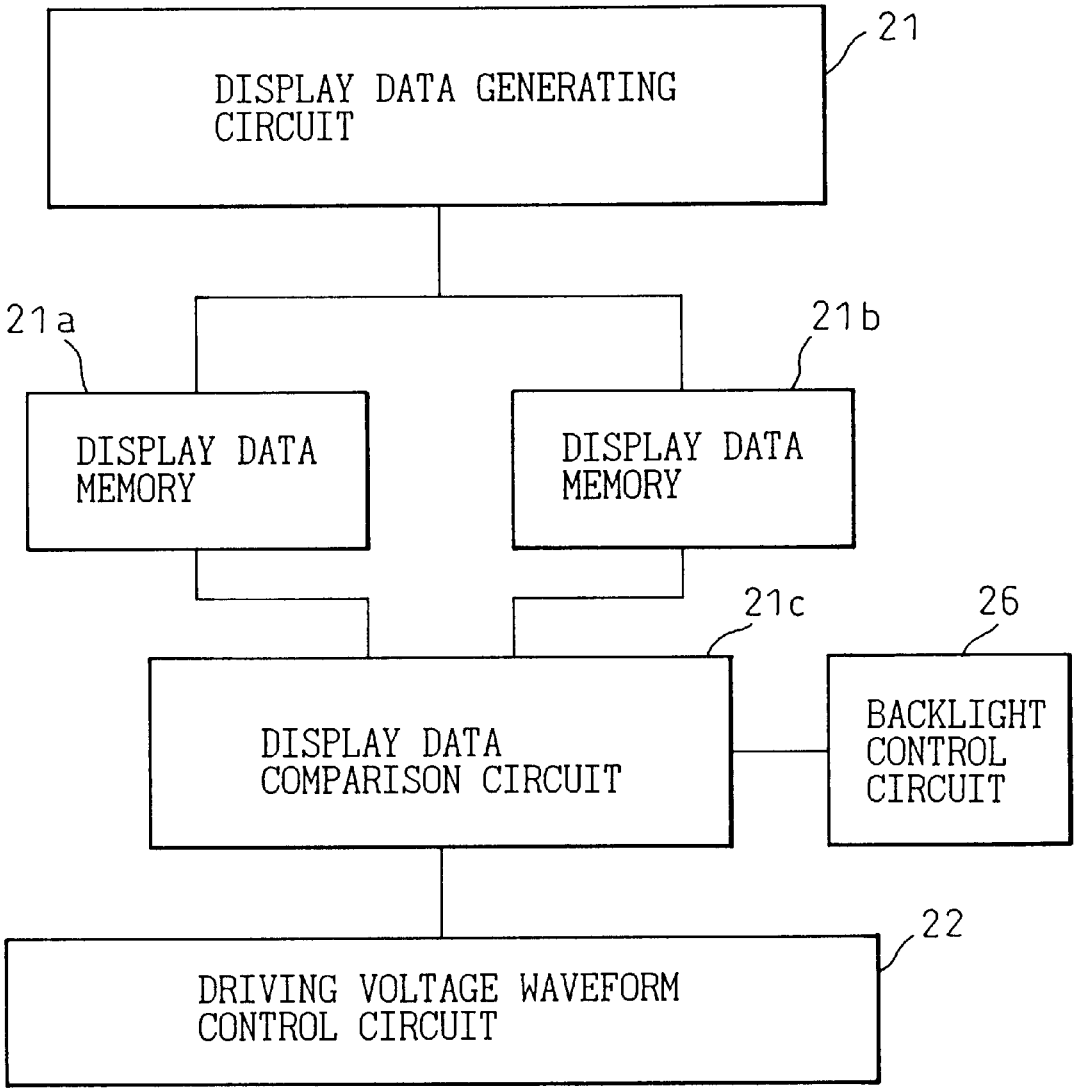
FIG. 10 is a block diagram showing the configuration of a display data comparison circuit equipped with display data memories.

Further, display data memories are provided so that display data for a plurality of frames can be stored. The circuit configuration for implementing this is shown in FIG. 10. This circuit comprises, in addition to the display data generating circuit 21, a first display data memory 21*a*, a second display data memory 21*b*, and a display data comparison circuit 21*c* as a device for comparing the display data. Display data of two successive screens are stored in the first and second display data memories 21*a* and 21*b*, and the stored data of the two successive frames are compared in the display data comparison circuit 21*c*. When the amount of change between the compared data is large, it is determined that a rapidly moving image is being displayed. On the other hand, when the amount of change between the compared data is small or zero, it is determined that a slowly moving image or a still image is being displayed. The result is input to the driving voltage wave control circuit 22. Then, when the amount of change between the compared data is large, the length of the reset period is automatically increased by means of the reset period adjusting control device 25, while when the amount of change is zero or nearly zero, the length of the reset period is automatically reduced.

In the above configuration, display data of two successive screens (frames) are stored in the first and second display data memories 21*a* and 21*b*, but the circuit may be configured to store display data at intervals of a suitable number of frames, for example, at intervals of two frames or three frames. Furthermore, in the present embodiment, two display data memories are provided, but three or more display data memories may be provided.

In this way, by providing the display data memories and using them in conjunction with the reset period duration adjusting device, even when the antiferroelectric liquid crystal display is incorporated into a larger apparatus as part of the apparatus, the length of the reset period can be automatically adjusted, and a good display quality requiring little maintenance can thus be maintained automatically.

Figure 11:
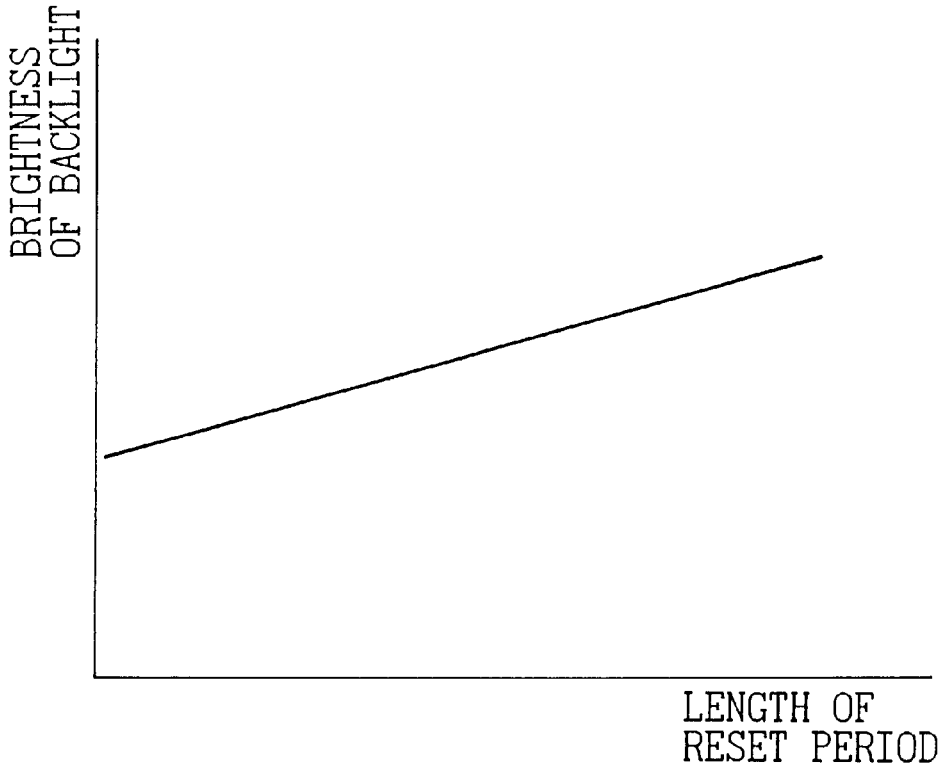
FIG. 11 is a diagram showing the relationship between the length of reset period and the brightness of backlight.

FIG. 11 is a diagram showing the relationship between the length of the reset period and the brightness of the backlight. As shown, the reset period adjusting control device 25 and the backlight control circuit 26 were set so as to increase the brightness of the backlight with increasing length of the reset period and to reduce the brightness with decreasing length of the reset period. By adjusting the brightness in this way, if the reset period for producing the black display was set long, a display sufficiently bright and having a good display quality was obtained.

Embodiment 2

A second embodiment of the present invention will be described in detail below with reference to the related drawings. The second embodiment, as in the first embodiment, employs the circuit configuration shown in FIG. 9 and the panel structure shown in FIG. 8. The polarizers are arranged as shown in FIG. 1, the same arrangement employed in the first embodiment, so that the non-transmission state is achieved in the antiferroelectric state and the transmission state in the first or second ferroelectric state. In the second embodiment, the backlight 4 is mounted behind the liquid crystal panel 3, as shown in FIG. 2.

Figure 12:
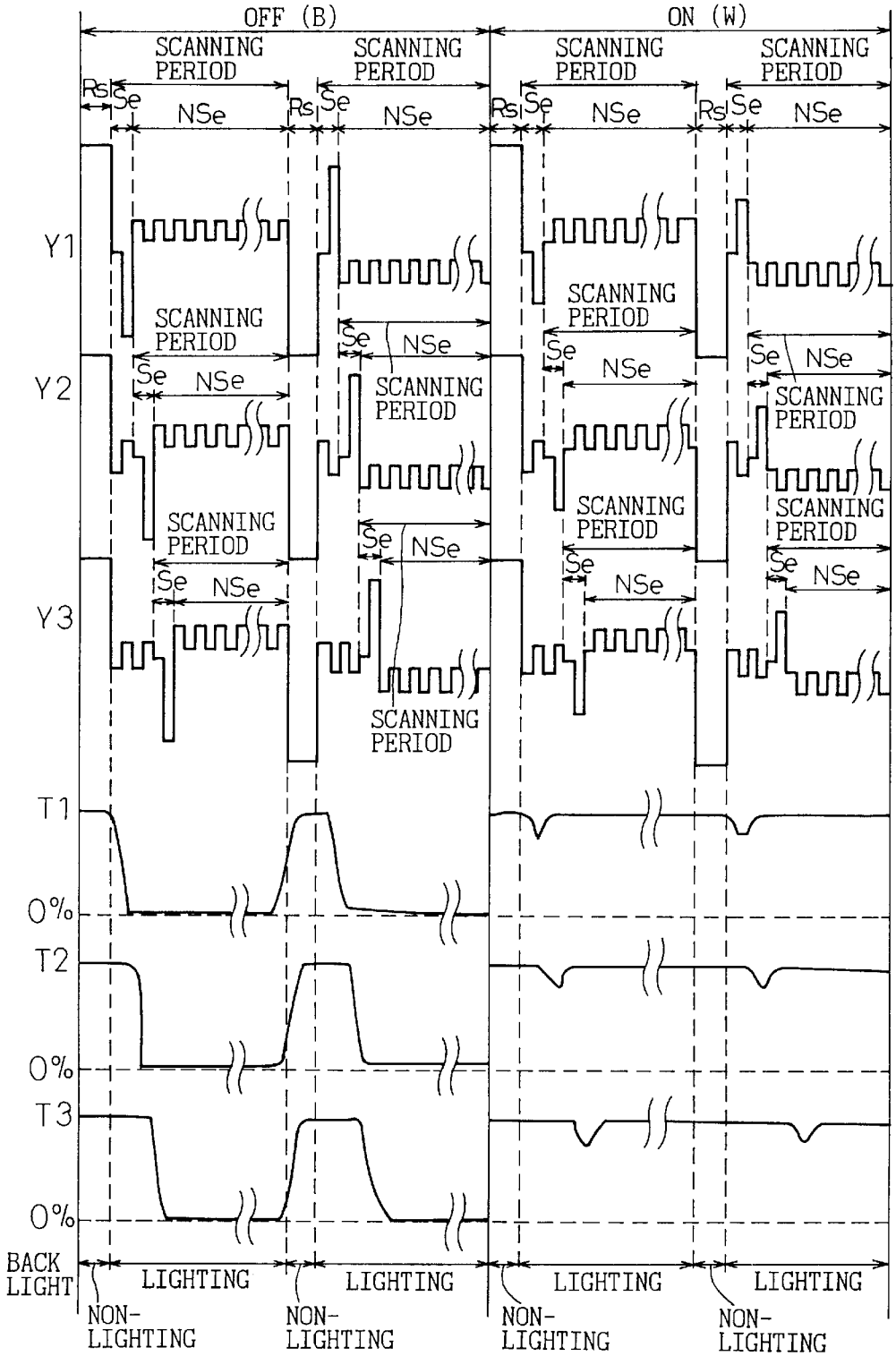
FIG. 12 is a diagram showing driving waveforms for the antiferroelectric liquid crystal display according to the present invention.

While, in the first embodiment, the antiferroelectric liquid crystal is reset to the antiferroelectric state in the reset period to produce a black display, in the second embodiment the antiferroelectric liquid crystal is reset to the first or second ferroelectric state in the reset period. FIG. 12 shows the driving waveforms used in this embodiment. Driving waveforms for the display data ON (white display state) and display data OFF (black display state) are shown together with their corresponding light transmittances. Y1, Y2, and Y3 designate composite voltages applied to pixels, and T1, T2, and T3 show the light transmittances when the respective composite voltages Y1, Y2, and Y3 are applied. The scanning voltage waveform comprises two scanning periods to display an image based on one set of display data, and the polarity of the voltage waveform is reversed symmetrically about 0 V between the two scanning periods. Each scanning period comprises a selection period (Se) for determining the display state based on the pixel display data and a non-selection period (NSe) for maintaining the state determined in the selection period (Se). A reset period (Rs) for resetting all the pixels simultaneously to the ferroelectric state is provided before one of or both of the scanning periods. Since all the pixels are reset simultaneously, the length of time that the pixels are held in the reset state increases in the order of the scanning electrodes to which the voltage is applied in sequence; therefore, the pixels on Y3 are held in the first or second ferroelectric state for a longer time than the pixels on Y1.

In the scanning voltage waveform, a voltage of 20 V is applied during the reset period provided before the first scanning period, and a voltage of −20 V is applied during the reset period provided before the second scanning period. In the first scanning period of the scanning voltage waveform, a voltage of 0 V is applied in the first phase of the selection period, a voltage of −10 V is applied in the second phase of the selection period, and a voltage of 8 V is applied during the non-selection period. On the other hand, in the second scanning period of the scanning voltage waveform, a voltage of 0 V is applied in the first phase of the selection period, a voltage of 10 V is applied in the second phase of the selection period, and a voltage of −8 V is applied during the non-selection period. From the signal voltage waveform, voltages of ±5 V are applied. The pulse width of each pulse is chosen to be about 35 $\mu$s. In FIG. 12, Y1 to Y3 each show the composite voltage waveform produced by summing the scanning voltage and signal voltage, and not the scanning voltage waveform itself.

Because the antiferroelectric liquid crystal is reset to the first or second ferroelectric state in the reset period, if the next display data is data for a black display state, a large voltage of a polarity opposite to that applied during the reset period is applied to set the antiferroelectric liquid crystal in the antiferroelectric state. Even when a voltage of an opposite polarity is applied that is large enough to switch the antiferroelectric liquid crystal, for example, from the first ferroelectric state to the second ferroelectric state, if the application period is set short, the state of the antiferroelectric liquid crystal does not change into the second ferroelectric state, but only switches to the antiferroelectric state. This state is maintained during the non-selection period, to produce the black display. On the other hand, when the display data is data for a white display state, if a voltage of the magnitude not large enough to cause switching to the antiferroelectric state is applied during the selection period, the first or second ferroelectric state achieved in the reset period is maintained during the selection and non-selection periods, thus producing the white display.

As shown in FIG. 12, in the reset period, the antiferroelectric liquid crystal is always reset to the first or second ferroelectric state, i.e., the transmission state, irrespective of the previous display state. At this time, the backlight was put in the non-lighting state in synchronism with the reset period. As a result, though the display was held in the transmission state during the reset period, the display appeared black, and the image trailing phenomenon was reduced. Further, though the length of the period of the reset state, the ferroelectric state, varies from pixel to pixel, the length of the period of the non-lighting state was set equal to that of the reset period of the pixel whose period of the ferroelectric reset state was the shortest, such as Y1 in FIG. 12.

Further, as in the first embodiment, provisions were made to be able to adjust the length of the reset period using the reset period adjusting control device while observing the condition of the displayed image. With these provisions, the image trailing phenomenon was not observed when the displayed image was a moving image with rapid motion or a still image with little motion. Furthermore, as in the first embodiment, display data memories were provided which were used in conjunction with the reset period duration adjusting device so that the length of the reset period could be automatically adjusted.

Moreover, as in the first embodiment, the reset period adjusting control device 25 and the backlight control circuit 26 were set so as to increase the brightness of the backlight with increasing length of the reset period and to reduce the brightness with decreasing length of the reset period. By adjusting the brightness in this way, if the reset period for producing the black display was set long, a display sufficiently bright and having a good display quality was obtained.

Embodiment 3

A third embodiment of the present invention will be described in detail below with reference to the related drawings. The third embodiment, as in the first embodiment, employs the circuit configuration shown in FIG. 9 and the panel structure shown in FIG. 8. However, the polarizers are arranged so that their polarization axes are oriented substantially at right angles to each other, and so that the direction of line bisecting the angle which is made by the polarization axes of the respective polarizers substantially coincides with the average molecular axis direction of the antiferroelectric liquid crystal molecules in the absence of an applied voltage, as shown in FIG. 5. When the polarizers are arranged in this manner, the antiferroelectric liquid crystal exhibits the applied voltage versus transmittance characteristics as illustrated in FIG. 6, achieving the transmission state when in the antiferroelectric state and the non-transmission state when in the first or second ferroelectric state. In this embodiment also, the backlight 4 is mounted behind the liquid crystal panel 3, as shown in FIG. 2.

FIG. 7 is a diagram showing the driving waveforms used in this embodiment for display data ON (white display state) and OFF (black display state), along with the amount of light transmitted through the liquid crystal panel, which changes depending on the applied voltage waveform. The driving waveform comprises two scanning periods to display an image based on one set of display data, and the polarity of the voltage waveform is reversed symmetrically about 0 V between the two scanning periods. Each scanning period comprises a selection period (Se) for determining the display state based on the pixel display data and a non-selection period (NSe) for maintaining the state determined in the selection period (Se). A reset period (Rs) for resetting the display always to a prescribed state, irrespective of the previous display state, is provided before the scanning period. In the present embodiment, the scanning voltage waveform in the reset period is set at ±20 V so that a composite voltage exceeding the threshold value is applied to the pixel during the reset period. In the reset period, the antiferroelectric liquid crystal is always reset to the first or second ferroelectric state, regardless of the previous display state, and the display is thus set in the black display state.

In the first scanning period of the scanning voltage waveform, a voltage of 0 V is applied in the first phase of the selection period (Se), a voltage of −10 V is applied in the second phase of the selection period, and a voltage of 8 V is applied during the non-selection period (Nse). A voltage of −20 V is applied during the reset period (Rs) preceding the second scanning period. In the second scanning period of the scanning voltage waveform, a voltage of 0 V is applied in the first phase of the selection period, a voltage of 10 V is applied in the second phase of the selection period, and a voltage of −8 V is applied during the non-selection period. A voltage of 20 V is applied during the reset period preceding the first scanning period. As the signal voltage waveform, voltages of ±5 V are applied. The pulse width of each pulse is chosen to be about 35 $\mu$s.

Since, in the reset period, the antiferroelectric liquid crystal is put in the ferroelectric state, that is, in the black display state, if the next display data is OFF (black display state), the state achieved in the reset period should be maintained. More specifically, a composite voltage waveform of the magnitude not large enough to cause the antiferroelectric liquid crystal to change to the antiferroelectric state is applied during the selection period to maintain the black display state. When the display data is ON (white display state), a large voltage opposite in polarity to the voltage applied during the reset period is applied as the composite voltage in the second phase of the selection period. Though this is a large voltage of opposite polarity, if the application period is set short, the antiferroelectric liquid crystal does not change from the ferroelectric state selected in the reset period to the other ferroelectric state, but only changes to the antiferroelectric state. In the non-selection period, this state is maintained to produce the white display.

Further, as in the first embodiment, provisions were made to be able to adjust the length of the reset period using the reset period adjusting control device 25 while observing the condition of the displayed image. When the antiferroelectric liquid crystal display was driven in this manner, the image trailing phenomenon was not observed when the displayed image was a moving image with rapid motion or a still image with little motion. Furthermore, as in the first embodiment, display data memories were provided which were used in conjunction with the reset period duration adjusting device so that the length of the reset period could be automatically adjusted.

Moreover, as in the first embodiment, the reset period adjusting control device 25 and the backlight control circuit 26 were set so as to increase the brightness of the backlight with increasing length of the reset period and to reduce the brightness with decreasing length of the reset period. By adjusting the brightness in this way, if the reset period for producing the black display was set long, a display sufficiently bright and having a good display quality was obtained.

Embodiment 4

A fourth embodiment of the present invention will be described in detail below with reference to the related drawings. The fourth embodiment, as in the third embodiment, employs the circuit configuration shown in FIG. 9 and the panel structure shown in FIG. 8. The polarizers are arranged as shown in FIG. 5, the same arrangement employed in the third embodiment, so that the transmission state is achieved in the antiferroelectric state and the non-transmission state in the first or second ferroelectric state. In this embodiment also, the backlight 4 is mounted behind the liquid crystal panel 3, as shown in FIG. 2.

Figure 13:
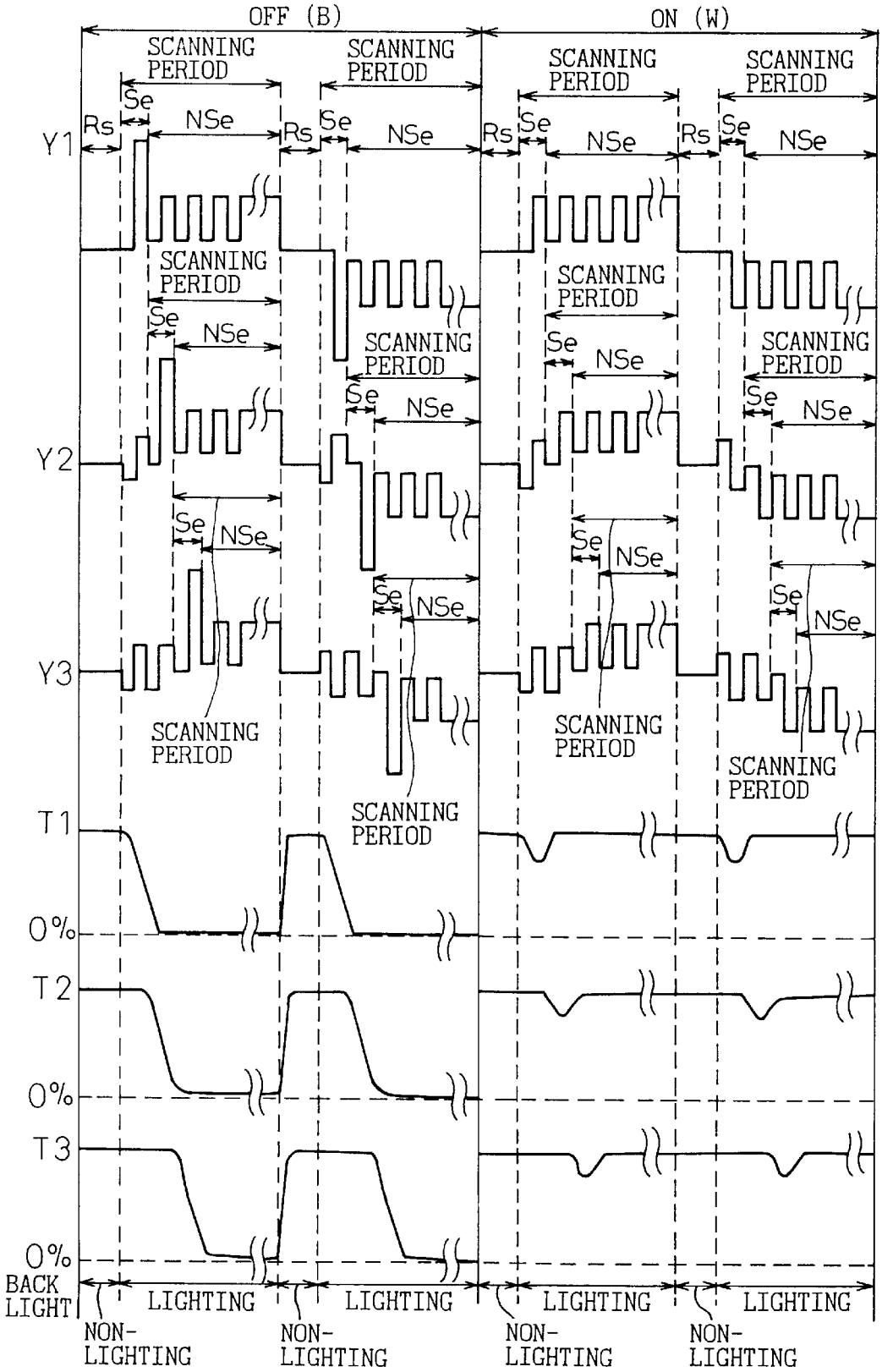
FIG. 13 is a diagram showing driving waveforms for the antiferroelectric liquid crystal display according to the present invention.

In the third embodiment the antiferroelectric liquid crystal is reset to the first or second ferroelectric state in the reset period to produce a black display but in the fourth embodiment the antiferroelectric liquid crystal is reset to the antiferroelectric state in the reset period. FIG. 13 shows the driving waveforms used in this embodiment. As an example, the driving waveforms for the display data OFF (black display state) and display data ON (white display state) are shown. In FIG. 13, Y1, Y2, and Y3 designate composite voltages applied to pixels, and T1, T2, and T3 show the amounts of transmitted light (light transmittances) when the respective composite voltages Y1, Y2, and Y3 are applied. The scanning voltage waveform comprises two scanning periods to display an image based on one set of display data, and the polarity of the voltage waveform is reversed symmetrically about 0 V between the two scanning periods. Each scanning period comprises a selection period (Se) for determining the display state based on the pixel display data and a non-selection period (NSe) for maintaining the state determined in the selection period (Se). A reset period (Rs) for resetting all the pixels simultaneously to the antiferroelectric state is provided before one of or both of the scanning periods.

In the first scanning period of the scanning voltage waveform, a voltage of 0 V is applied in the first phase of the selection period, a voltage of 20 V is applied in the second phase of the selection period, and a voltage of 8 V is applied during the non-selection period. On the other hand, in the second scanning period of the scanning voltage waveform, a voltage of 0 V is applied in the first phase of the selection period, a voltage of −20 V is applied in the second phase of the selection period, and a voltage of −8 V is applied during the non-selection period. From the signal voltage waveform, voltages of ±5 V are applied. The pulse width of each pulse is chosen to be about 35 $\mu$s. In FIG. 13, Y1 to Y3 each show the composite voltage waveform produced by summing the scanning voltage and signal voltage.

In the reset period, the antiferroelectric liquid crystal is reset to the antiferroelectric state, and is thus put in the white display state. Therefore, if the next display data is OFF (black display state), a voltage of the magnitude sufficiently larger than the threshold voltage, and large enough to cause a transition to the first or second ferroelectric state, is applied to the pixel to switch the liquid crystal to the first or second ferroelectric state. This state is maintained during the non-selection period to produce the black display. On the other hand, when the display data is for a white display state, a voltage of 0 V or a voltage not large enough to cause switching to the ferroelectric state is applied during the selection period; as a result, the antiferroelectric state achieved in the reset period is maintained during the selection and non-selection periods, thus producing the white display.

As shown in FIG. 13, in the reset period, the antiferroelectric liquid crystal is always reset to the antiferroelectric state, i.e., the transmission state, irrespective of the previous display state. At this time, the backlight was put in the non-lighting state in synchronism with the reset period. As a result, though the display was held in the transmission state during the reset period, the display appeared black, and the image trailing phenomenon was reduced. Further, the length of the period of the non-lighting state was set equal to that of the reset period of Y1 whose period of the reset state was the shortest.

Further, as in the first embodiment, provisions were made to be able to adjust the length of the reset period using the reset period adjusting control device 25 while observing the condition of the displayed image. As a result, the image trailing phenomenon was not observed when the displayed image was a moving image with rapid motion or a still image with little motion. Furthermore, as in the first embodiment, display data memories were provided which were used in conjunction with the reset period duration adjusting device so that the length of the reset period could be automatically adjusted.

Moreover, as in the first embodiment, the reset period adjusting control device 25 and the backlight control circuit 26 were set so as to increase the brightness of the backlight with increasing length of the reset period and to reduce the brightness with decreasing length of the reset period. By adjusting the brightness in this way, if the reset period for producing the black display was set long, a display sufficiently bright and having a good display quality was obtained.

In the driving methods employed in the first to fourth embodiments, one frame is used to display one display data, and one frame is made up of two scanning periods between which the polarity of the applied voltage is reversed symmetrically. Further, a reset period is provided before each scanning period. However, it is not mandatory to provide two reset periods in each frame, but only one reset period may be provided, that is, one only before the first scanning period.

By employing the driving method that matches the polarizer arrangement, the antiferroelectric liquid crystal display of the present invention can provide a good display quality by eliminating the image trailing phenomenon. Furthermore, a good display with its brightness maintained at a constant level can be produced whether the displayed image is an image with little motion, such as a still image, or a moving image with rapid motion, such as one for a video game.

Summarizing the advantageous effects of the invention, explained above, the invention provides an antiferroelectric liquid crystal display equipped with an antiferroelectric liquid crystal panel having an antiferroelectric liquid crystal sandwiched between a pair of substrates, wherein the antiferroelectric liquid crystal display performs at least one scanning period when carrying out a display based on one set of display data, and the scanning period includes a selection period for determining the state of the antiferroelectric liquid crystal, a non-selection period for holding the state determined in the selection period, and a reset period for resetting pixels to a black display state before initiating the selection period, and wherein the antiferroelectric liquid crystal display includes a device for adjusting the length of the reset period according to the speed of change in the display data.

The length of the reset period is increased when the speed of change in the display data is fast, and is reduced when the speed is slow.

The antiferroelectric liquid crystal display includes a backlight and a device for adjusting the brightness of the backlight according to the length of the reset period.

The brightness of the backlight is increased when the length of the reset period is increased, and is reduced when the length is reduced.

The speed of change in the display data is detected by comparing display data of approximately successive frames.

The antiferroelectric liquid crystal display is characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the polarization axis of either one of the polarizers substantially coincides with the average molecular long axis direction of the antiferroelectric liquid crystal in the absence of an applied voltage, and in that, in the reset period, the antiferroelectric liquid crystal is set to the antiferroelectric state.

The antiferroelectric liquid crystal display is also characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the direction of line bisecting the angle which is made by the polarization axes of the polarizers substantially coincides with the average molecular long axis direction of the antiferroelectric liquid crystal in the absence of an applied voltage, and in that in the reset period, the antiferroelectric liquid crystal is set to the first or second ferroelectric state.

The invention also provides an antiferroelectric liquid crystal display equipped with a backlight and an antiferroelectric liquid crystal panel having an antiferroelectric liquid crystal sandwiched between a pair of substrates, wherein the antiferroelectric liquid crystal display performs at least one scanning period when producing a display based on display data for one frame, and the scanning period comprises a selection period for determining the state of the antiferroelectric liquid crystal, a non-selection period for holding the state determined in the selection period, and a reset period for resetting all pixels simultaneously to a white display state before initiating the selection period, and wherein the backlight is turned off during the reset period.

The antiferroelectric liquid crystal display includes a device for adjusting the length of the reset period according to the speed of change in the display data.

The length of the reset period is increased when the speed of change in the display data is fast, and is reduced when the speed is slow.

The speed of change in the display data is detected by comparing display data of approximately successive frames.

The antiferroelectric liquid crystal display includes a device for adjusting the brightness of the backlight according to the length of the reset period.

The brightness of the backlight is increased when the length of the reset period is increased, and is reduced when the length is reduced.

The antiferroelectric liquid crystal display is characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the polarization axis of either one of the polarizers substantially coincides with the average molecular long axis direction of the antiferroelectric liquid crystal in the absence of an applied voltage, and in that in the reset period, the antiferroelectric liquid crystal is set to the first or second ferroelectric state.

The antiferroelectric liquid crystal display is also characterized in that the antiferroelectric liquid crystal display includes a pair of polarizers whose polarization axes are oriented substantially at right angles to each other, in that the antiferroelectric liquid crystal is capable of exhibiting an antiferroelectric state, a first ferroelectric state, and a second ferroelectric state, in that the pair of polarizers are arranged so that the direction of line bisecting the angle which is made by the polarization axes of the polarizers substantially coincides with the average molecular long axis direction of the antiferroelectric liquid crystal in the absence of an applied voltage, and in that in the reset period, the antiferroelectric liquid crystal is set to the antiferroelectric state.

What is claimed is:

1. An antiferroelectric liquid crystal display equipped with an antiferroelectric liquid crystal panel having an antiferroelectric liquid crystal sandwiched between a pair of substrates, wherein the antiferroelectric liquid crystal display is provided with at least one scanning period when carrying out a display based on one set of display data, and the scanning period comprises a selection period for determining the state of the antiferroelectric liquid crystal, a non-selection period for holding the state determined in the selection period, and a reset period for resetting pixels to a black display state before initiating the selection period, and wherein the antiferroelectric liquid crystal display includes a device for adjusting the length of the reset period according to the speed of change in the display data the device being adjustable to increase the length of the reset period when the speed of change in the display data is fast, and to reduce the length of the reset period when the speed of change is slow.

2. An antiferroelectric liquid crystal display as claimed in claim 1, wherein the antiferroelectric liquid crystal display includes a backlight and a device for adjusting the brightness of the backlight according to the length of the reset period.

3. An antiferroelectric liquid crystal display as claimed in claim 2, wherein the brightness of the backlight is increased when the length of the reset period is increased, and is reduced when the length of the reset period is reduced.

4. An antiferroelectric liquid crystal display as claimed in claim 1, further comprising a comparison circuit wherein the speed of change in the display data is detected by comparing display data of approximately successive frames.

5. An antiferroelectric liquid crystal display as claimed in claim 1, wherein the antiferroelectric liquid crystal display includes a pair of polarizers whose polarization axes are oriented substantially at right angles to each other, the antiferroelectric liquid crystal is capable of exhibiting an antiferroelectric state, a first ferroelectric state, and a second ferroelectric state, and the pair of polarizers are arranged so that the polarization axis of either one of the polarizers substantially coincides with the average molecular long axis direction of the antiferroelectric liquid crystal in the absence of an applied voltage, and wherein in said reset period, the antiferroelectric liquid crystal is set to the antiferroelectric state.

6. An antiferroelectric liquid crystal display as claimed in claim 1, wherein the antiferroelectric liquid crystal display includes a pair of polarizers whose polarization axes are oriented substantially at right angles to each other, the antiferroelectric liquid crystal is capable of exhibiting an antiferroelectric state, a first ferroelectric state, and a second ferroelectric state, and the pair of polarizers are arranged so that the direction of line bisecting the angle which is made by the polarization axes of the polarizers substantially coincides with the average molecular long axis direction of the antiferroelectric liquid crystal in the absence of an applied voltage, and wherein in the reset period, the antiferroelectric liquid crystal is set to the first or second ferroelectric state.

7. An antiferroelectric liquid crystal display equipped with a backlight and an antiferroelectric liquid crystal panel having an antiferroelectric liquid crystal sandwiched between a pair of substrates, wherein the antiferroelectric liquid crystal display is provided with at least one scanning period when carrying out a display based on one set of display data, and the scanning period comprises a selection period for determining the state of the antiferroelectric liquid crystal, a non-selection period for holding the state determined in the selection period, and a reset period for resetting all pixels simultaneously to a white display state before initiating the selection period, and wherein the antiferroelectric liquid crystal display includes a device for adjusting the length of the reset period according to the speed of change in the display data, the device being adjustable to increase the length of the reset period when the speed of change in display data is fast, and to reduce the length of the reset period when the speed of change is slow, and wherein the backlight is turned off during the reset period.

8. An antiferroelectric liquid crystal display as claimed in claim 7, further comprising a comparison circuit wherein the speed of change in the display data is detected by comparing display data of approximately successive frames.

9. An antiferroelectric liquid crystal display as claimed in claim 7, wherein the antiferroelectric liquid crystal display includes a device for adjusting the brightness of the backlight according to the length of said reset period.

10. An antiferroelectric liquid crystal display as claimed in claim 9, wherein the brightness of the backlight is increased when the length of the reset period is increased, and is reduced when the length of the reset period is reduced.

11. An antiferroelectric liquid crystal display as claimed in claim 7, wherein the antiferroelectric liquid crystal display includes a pair of polarizers whose polarization axes are oriented substantially at right angles to each other, the antiferroelectric liquid crystal is capable of exhibiting an antiferroelectric state, a first ferroelectric state, and a second ferroelectric state, and the pair of polarizers are arranged so that the polarization axis of either one of the polarizers substantially coincides with the average molecular long axis direction of the antiferroelectric liquid crystal in the absence of an applied voltage, and wherein, in the reset period, the antiferroelectric liquid crystal is set to the first or second ferroelectric state.

12. An antiferroelectric liquid crystal display as claimed in claim 7, wherein the antiferroelectric liquid crystal display includes a pair of polarizers whose polarization axes are oriented substantially at right angles to each other, the antiferroelectric liquid crystal is capable of exhibiting an antiferroelectric state, a first ferroelectric state, and a second ferroelectric state, and the pair of polarizers are arranged so that the direction of line bisecting the angle which is made by the polarization axes of the polarizers make substantially coincides with the average molecular long axis direction of the antiferroelectric liquid crystal in the absence of an applied voltage, and wherein in the reset period, the antiferroelectric liquid crystal is set the antiferroelectric state.

* * * * *